United States Patent [19]

Zernig

[11] 4,227,284

[45] Oct. 14, 1980

[54] BASE OR ADJUSTMENT PLATE FOR CABINET HINGES

[75] Inventor: Ernst Zernig, Hemer, Fed. Rep. of Germany

[73] Assignee: Firma Richard Heinze GmbH & Co. KG, Fed. Rep. of Germany

[21] Appl. No.: 905,525

[22] Filed: May 12, 1978

[30] Foreign Application Priority Data

May 13, 1977 [DE] Fed. Rep. of Germany ..... 2721625

[51] Int. Cl.[2] ..... E05D 7/04

[52] U.S. Cl. ..... 16/129; 16/130; 16/DIG. 39

[58] Field of Search ..... 16/129, 130, 131, 132, 16/DIG. 39, 163, 164

[56] References Cited

U.S. PATENT DOCUMENTS

| | | | |
|---|---|---|---|
| 1,716,489 | 6/1929 | Garlick | 16/DIG. 39 |
| 3,251,088 | 5/1966 | Boundy | 16/130 X |
| 3,772,735 | 11/1973 | Lautenschlaeger | 16/129 |
| 3,969,787 | 7/1976 | Röck et al. | 16/129 |
| 4,011,627 | 3/1977 | Salice | 16/129 |
| 4,104,762 | 8/1978 | Röck et al. | 16/129 |

FOREIGN PATENT DOCUMENTS

| | | | |
|---|---|---|---|
| 2025645 | 12/1971 | Fed. Rep. of Germany | 16/129 |
| 2057261 | 7/1977 | Fed. Rep. of Germany | 16/130 |

*Primary Examiner*—G. J. Husar
*Assistant Examiner*—Moshe I. Cohen
*Attorney, Agent, or Firm*—Jacobs & Jacobs

[57] ABSTRACT

The invention relates to a base or adjustment plate for a cabinet hinge for the adjustable attachment of a hinge arm to a cabinet part. The base or adjustment plate consists of an intermediate carrier which can be fastened to a cabinet part and of a bearing element which is fastened to the intermediate carrier in a manner such that it is adjustable along a first axis in space extending parallel to the surface of said cabinet part and serves for the adjustable attachment of the hinge arm in at least one second axis in space extending perpendicular to the first, a guide with lateral guide surfaces being formed between the intermediate carrier and the bearing element by at least one recess extending in the direction of said first axis in space and at least one guide extension engaging into the recess, the guide preventing displacement of the bearing element perpendicular to the first axis in space. Means are furthermore provided for pressing the bearing element against the intermediate carrier. At least one guide surface is inclined, the extension having in the region of this guide surface, in a direction perpendicular to the first axis in space, a slightly greater width than the recess, so that upon the tightening of the means for applying the bearing element against the intermediate carrier the extension is clamped fast in the recess.

8 Claims, 6 Drawing Figures

(II-II)

(I-I)

BASE OR ADJUSTMENT PLATE FOR CABINET HINGES

This invention relates to a base or adjustment plate for cabinet hinges for the adjustable attachment of a hinge arm to a cabinet part, consisting of an intermediate carrier a surface side of which is adapted to be fastened to the cabinet part, and of a bearing element which is fastened to the intermediate carrier in a manner adjustable in a first axis in space extending parallel to said surface side and serves for the adjustable attachment of the hinge arm in at least one second axis in space extending perpendicular to the first, lateral guide surfaces being formed between the intermediate carrier and the bearing element by at least one recess extending in the direction of said first axis in space and at least one guide extension engaging into the recess, which guide surfaces prevent shifting of the bearing element perpendicular to the first axis in space, means being provided for pressing the bearing element against the intermediate carrier.

It is today generally customary, in the case of cabinet hinges, to fasten the hinge arm, which has one or more pivot pins indirectly via a base plate or adjustment plate to a cabinet part, for instance to a cabinet side wall in order, inter alia, to obtain the possibility of adjusting the hinge arm in order to compensate for manufacturing tolerances in the manufacture of the hinge and/or cabinet. Particularly in cases in which an adjustment of the hinge arm in transverse direction or in the direction of the hinge pins is also desired, use is made of base or adjustment plates which consist of two parts which are movable relative to each other, the first part being adapted to be fastened as intermediate carrier directly to the cabinet part in question while the second part is fastened adjustably to the intermediate carrier as bearing element for the hinge arm. Due to the high stresses to which cabinet hinges are exposed, it is necessary to develop the connection between the intermediate carrier and the bearing element in such a manner that undesired loosening of the connection between these two parts does not take place, even upon lengthy use of the hinge.

The object of the present invention is to disclose a base or adjustment plate of the type described above which permits a dependable anchoring between the intermediate carrier and the bearing element, despite simple and inexpensive manufacture.

In order to achieve this purpose, a base or adjustment plate of the type described above is developed in accordance with the invention in the manner that at least one guide surface is inclined with respect to the surface side and that the extension, in the region of this guide surface, has a slightly greater width in the direction perpendicular to said first axis in space than the recess has.

By this development, upon the tightening of the means for pressing the bearing element against the intermediate carrier, the extension is forced in wedge shape into the recess and anchored in the recess so that the connection between the intermediate carrier and the bearing element cannot loosen, even upon lengthy use of a hinge in a cabinet.

The development of a base or adjustment plate in accordance with the invention has furthermore also the advantage that the said means, namely recess and extension, serve to lock or fix the bearing element on the intermediate carrier as a result of the above-mentioned clamping effect, at the same time assume the guidance between the two parts, i.e. prevent an undesired displacement between these parts in the direction perpendicular to the first axis in space or a tilting or turning of the two parts with respect to each other. As a result of this multiple function of the extension and recess, there is obtained a substantial simplification of the construction of the base or adjustment plate of the invention.

The invention will be explained in further detail below on an illustrative embodiment, referred to the drawing, in which.

Figure 1:
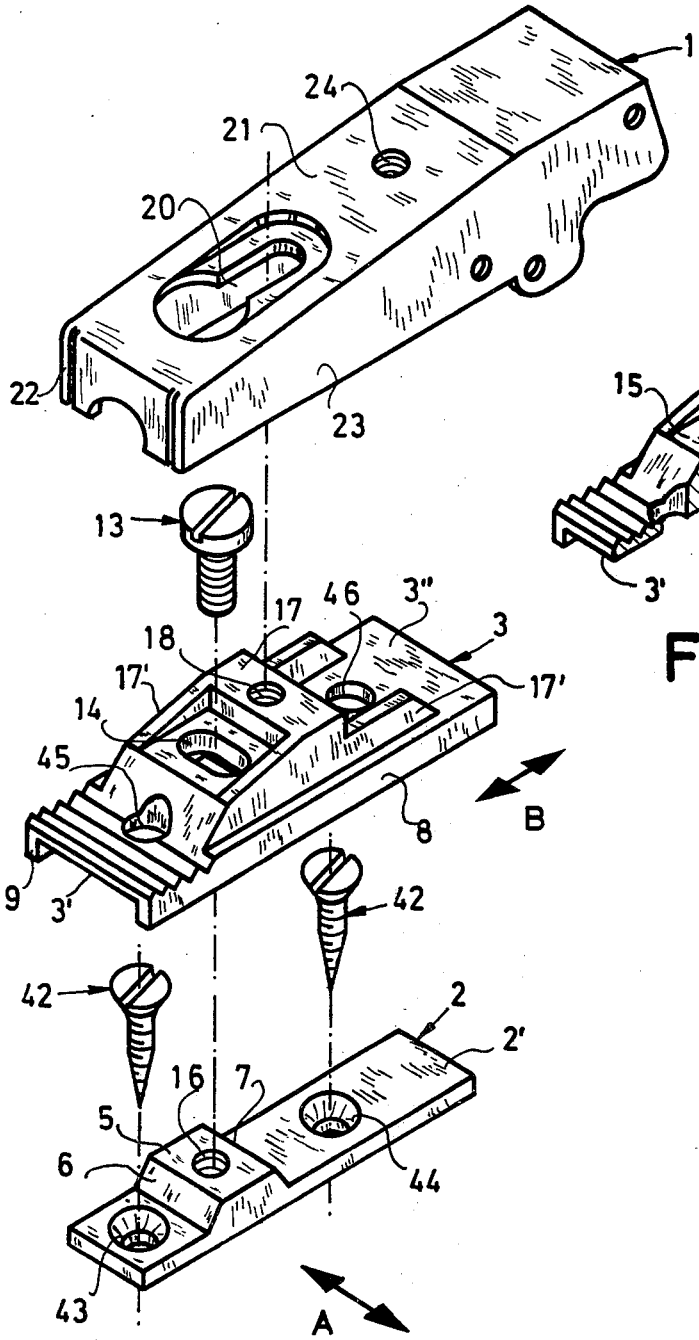
FIG. 1 is an exploded view in perspective of a hinge arm of a cabinet hinge together with a base or adjustment plate consisting of a carrier and an intermediate carrier, in the case of a hinge in accordance with the invention.
Figure 2:
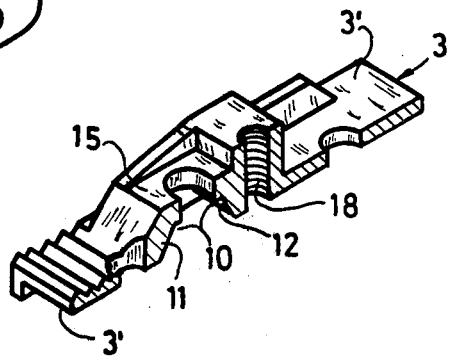
FIG. 2 is a perspective view of the carrier or bearing element of the base or adjustment plate of FIG. 1, cut in longitudinal direction.

In the figures, 1 is a hinge arm of U-shaped cross section which can be fastened to a cabinet side wall 4, in a manner adjustable along three axes in space which are perpendicular to each other, by means of a base or adjustment plate which consists of the intermediate carrier 2 and the bearing element or carrier 3. In the embodiment shown, the intermediate carrier 2 as well as the bearing element 3 are both developed in plate shape, the intermediate carrier 2 having on the topside 2' thereof which faces away from the surface of the cabinet wall 4 when the hinge is fastened, an extension 5 which extends over the entire width of the rectangular intermediate carrier 3 and has a trapezoidal cross section in the direction perpendicular to the longitudinal axis of said intermediate carrier, i.e. in the direction indicated by the double-ended arrow A, the extension 5, starting from the topside 2' of the intermediate carrier 2, tapering towards its free end and having on each of the sides facing the ends of the intermediate carrier 2 lateral guide surface, 6 and 7 respectively, which are oblique to the topside 2' and extend in the direction of the double-ended arrow A.

The carrier or the bearing element 3 is developed on its bottom 3' in U-shape with legs 8 and 9 protruding perpendicularly from said bottom and has on this bottom side which faces the topside 2' of the intermediate carrier 2 a recess 10 which corresponds to the extension 5 and also extends in the direction indicated by the double-armed arrow A and narrows down in trapezoidal shape starting from the bottom side 3' so as to form lateral guide surfaces 11 and 12 extending obliquely to the bottom side 3'. The distance apart of the legs 8 and 9 of the bearing element 3 is greater than the width of the intermediate carrier 2 so that the bearing element 3 can be displaced in the direction indicated by the double-ended arrow A on the intermediate carrier 2 which is arranged almost invisibly between the legs 8 and 9 and extends via its extension 5 into the recess by a certain amount (difference between the distance between the legs 8 and 9 and the width of the intermediate carrier 2). In order to fasten the bearing element 3 to the intermediate carrier there is used a screw 13 which extends through a slot 14, extending in the direction indicated by the double-ended arrow A and located in the upper region 15 of the recess 10, into a thread 16 in the extension, while its head rests against the side of the upper region 15 which faces away from the recess 10.

In order to be able to provide the recess on the bottom side 3' even in case of a relatively thin development of the bearing element 3, the bearing element 3 is provided on its top side 3'' with an elevation 17 of substantially step-shaped course, the recess 10 being located below the region of lower height of said elevation 17 while within the region of larger height there is provided a thread 18 for a holding screw 19 which engages, through a keyhole-shaped recess 20 in the yoke surface 21 of the hinge arm 1, into the thread 18 and serves to hold the hinge arm 1 against the bearing element 3.

The width of the elevation 17 is less than the width of the rest of the bearing element 3 and corresponds approximately to the distance between the inner side of the sides 22 and 23 of the hinge arm which extend perpendicular to the yoke surface 21 so that the longitudinal sides 17' of the elevation 17 which extend perpendicular to the double-ended arrow A form guide surfaces for the hinge arm 1 or its sides 22 and 23 and permit displacement of the hinge arm 1 in the longitudinal direction of the bearing element 3 or in the direction indicated by the double-ended arrow B. In order to obtain at the same time also an adjustment of the hinge arm in the direction perpendicular to the surface of the cabinet wall 4, i.e. in the direction indicated by the double-ended arrow C, a thread 24 is provided in known manner in the yoke surface 21 of the hinge arm 1, for an adjustment screw 25, the lower end of which forms an adjustable stop surface, resting against the top 3'' of the bearing element 3, for the hinge arm.

In the sides 22 and 23 there are supported, at one end of the hinge arm 1, pivot pins 26 and 27 to each of which there is pivoted one end of a hinge lever 28 and 29 respectively, the other ends of which are pivotally connected via hinge pins 30 and 31 with a hinge housing 32 which can be fastened in a recess of a cabinet door (not shown in detail).

Figure 3:
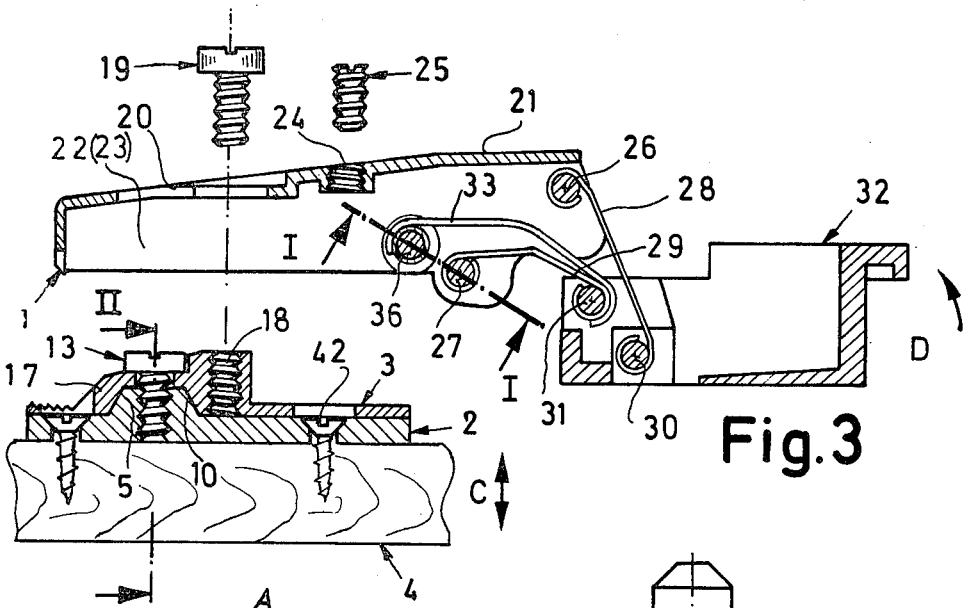
FIG. 3 is a longitudinal section through the entire hinge of the invention, the hinge arm being removed from the base or adjustment plate which is to be fastened to a cabinet side wall.
Figure 4:
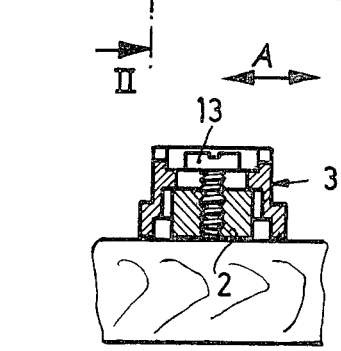
FIG. 4 is a section along the line II—II of FIG. 3.
Figure 6:
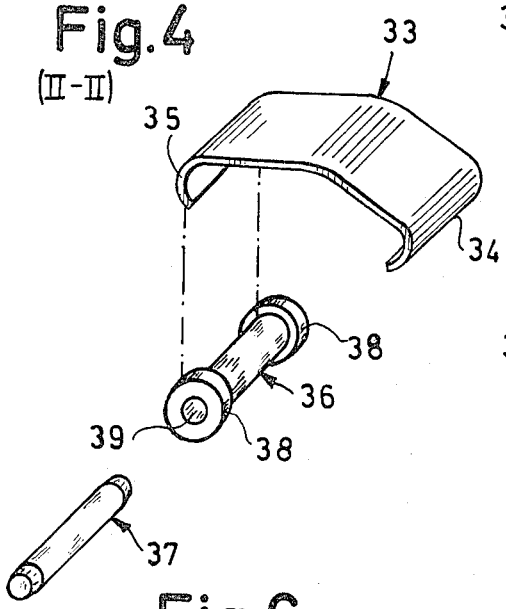
FIG. 6 shows in a detailed perspective view a spring element, developed as leaf spring, for use in the hinge of FIGS. 1 to 5, together with a bearing sleeve for the spring element.

FIG. 3 shows the position of the hinge housing 32 in the door-open position. Upon the closing of the door, the hinge housing 32 is swung, in the direction of the arrow D, into a position which is 90° away from the position shown in FIG. 3. In order now, upon the closing of the cabinet door which is connected with the hinge housing 32, to obtain, at least at the end of the closing movement, an automatic, complete closing of the cabinet door and furthermore hold the door fast in the closed position so that it can be opened again only after a given force has been overcome, a curved leaf spring 33 is provided. It has its partially rolled end 34 attached to the hinge housing 32 or to the hinge sleeve of the hinge lever 29 which surrounds the hinge pin 31. The other partially rolled end 35 of the leaf spring 33 is fastened to or suspended on a sleeve 36 which is held between the arms 22 and 23 of the hinge arm 1 by means of a pin 37. The arrangement of the sleeve 36 in the hinge arm 1 is such that the leaf spring 33, upon the closing of the cabinet door, i.e. upon the movement of the hinge housing 32 in the direction indicated by the arrow D, is first of all deformed in the direction of lesser curvature in order to increase the spring force acting between the sleeve 36 and the hinge pin 31 or between the hinge arm 1 and the hinge housing 32, and then relaxes again, as a result of which the cabinet door as well as the hinge housing 32 are pressed automatically by the relaxing spring 33 into the closed position and held fast therein. The leaf spring 33 preferably consists of spring steel, but may however also be made of flexible plastic.

In order to obtain by means of the leaf spring 33 sufficient force to hold the cabinet door in closed position and to assure dependable operation of the hinge, i.e. in particular also a sufficient anchoring of the leaf spring on the sleeve 36 or on the hinge sleeve surrounding the hinge pin 31 of the hinge lever 29, it is necessary to pretension the leaf spring 33 in such a manner that it is not completely relaxed in any position of the hinge. In particular, the leaf spring 33 must still have a certain tension even in those positios of the hinge in which the least tension is present in the leaf spring (for instance, hinge-open position). The sleeve 36 serves to facilitate the mounting of the pretensioned leaf spring 33. For this purpose the sleeve 36 has on each of its ends a section (collar) 38 whose cross section is greater than the rest of the cross section of the sleeve 36. The leaf spring 33 has its end 35 lying between the sections 38. The diameter of the sections 38 is such that the sleeve 36 rests by means of the sections 38, when the pin 37 is still not mounted but the leaf spring 33 has been placed on, against the hinge sleeve of the hinge lever 29 which surrounds the hinge pin 27 on the hinge-arm side. In this way the sleeve 36 finds support, even if the leaf spring 33 is only slightly tensioned until the final mounting of the pin 37, the inner bore 39 of the sleeve 36 being displaced only slightly with respect to the bearing holes 40 and 41 which are provided in the sides 22 and 23 of the hinge arm for the pin 37 (see FIG. 5). The partial overlapping of the bearing holes 40 and 41 with the inner bore 39 of the sleeve 36 is achieved in the manner that the difference between the distances between the bearing holes 40 and 41 and the hinge sleeve of the hinge lever 39 surrounding the hinge pin 37 and between the inner bore 39 and the circumferential surface of the section 38 is less than the diameter of the bearing holes 40 and 41 or of the inner bore 39.

Figure 5:
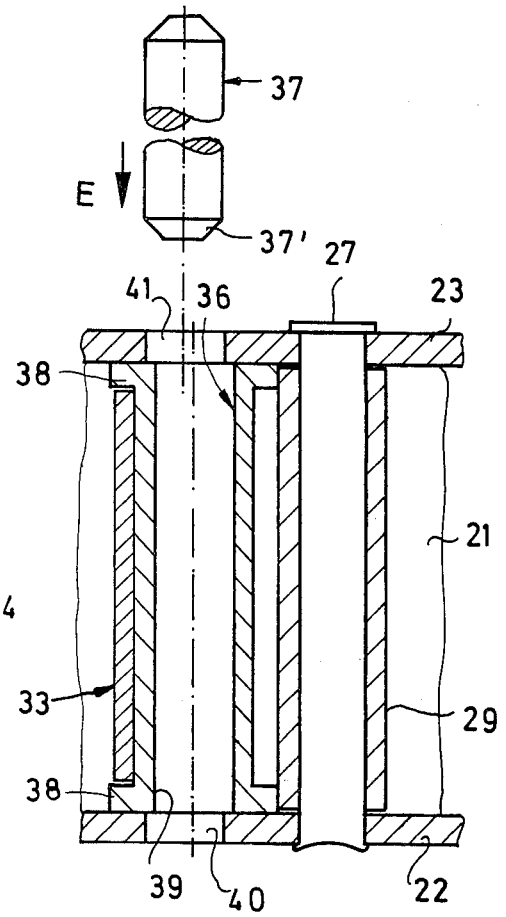
FIG. 5 is a section along the line I—I of FIG. 3.

In the position shown in FIG. 5, in which the sleeve 36 and the hinge arm 21 have with respect to each other, it is then possible without difficulty to push the pin 37 in the direction of the arrow E from the side through the bearing bore 41 in the side 23 into the inner bore of the sleeve, the sleeve 36 being pushed by the tapered end 37' of the pin 37 so far to the side away from the hinge pin 27 that the inner bore 39 is aligned with the bearing holes 40 and 41 and the end of the pin 37 provided with the taper 37' can be pushed through the sleeve 36 into the second bearing borehole 40 in the side 22. In the embodiment shown, the length of the sleeve 36 is furthermore selected equal to the distance of the sides 22 and 23 from each other so that upon the introduction of the pin 37 through the bearing hole 41 into the inner bore 39 the sleeve 36 cannot become askew and thus the entrance of the pin 37 into the bearing borehole 40 is also assured. Since, after the insertion of the pin 37, the bearing boreholes 40 and 41 are aligned with the inner borehole 39, the sleeve 36 is displaced to the side to such an extent away from the hinge sleeve which surrounds the hinge pin 27 that the hinge lever 29 upon swinging does not rub against the sections 38 of the sleeve and furthermore the leaf spring 33 is additionally tensioned.

After the insertion of the pin 37, it is anchored in the customary manner at both ends in the sides 22 and 23 of the hinge arm, for instance by clinching.

For the fastening of the hinge to the cabinet side wall 4, fastening screws 42 are first of all inserted into the boreholes 43 and 44 which are provided on the intermediate carrier on both sides of the extension 5. Thereupon, the bearing element 3 is placed on the intermediate carrier 2 in such a manner that the intermediate carrier 2 lies between the legs 8 and 9 of the bearing element and the extension 5 engages into the recess 10. By introducing the screw 13 into the slot 14 and by turning the screw into the thread 16 the bearing element is then secured on the intermediate carrier 2, the fastening screws 42 remaining accessible to a screwdriver through the boreholes 45 and 46 in the bearing element. The base or adjustment plate which consists of the intermediate carrier 2 and the bearing element 3 can be delivered in this condition from the hardware manufacturer to the customer, for instance to a cabinet manufacturer, who then fastens the base or adjustment plate to the side wall 4 of the cabinet by means of the fastening screws 42, as shown in FIG. 3.

Thereupon, the holding screw 19 is turned into the thread 18 to an extent such that said holding screw still protrudes sufficiently beyond the bearing element 3. The tightening of the holding screw 19 can in this connection of course also be effected by the hardware or hinge manufacturer. For the final mounting of the hinge on the side wall 4 of the cabinet the hinge arm 1, which is premounted with all necessary hinge parts, is placed on the base or adjustment plate, for which purpose the head of the holding screw 19 is first of all passed through the cross sectional portion of greater width of the keyhole-shaped recess 20 of the hinge arm 1 and the hinge arm 1 is pushed relative to the bearing element 3 in such a manner that the holding screw 19 is finally located in the region of smaller cross section of the recess 20 and the head of the screw 19 rests against the top of the yoke surface 21 of the hinge arm 1. Before the holding screw 19 is finally tightened, the hinge arm is adjusted in the direction of the double-ended arrows B and C by means of the adjustment screws 25 and by longitudinal displacement of the hinge arm relative to the bearing element 3, in known manner.

Even after the placing of the hinge arm 1 on the bearing element 3, the screw 13 is still accessible for a screwdriver through the region of larger cross section of the keyhole-shaped recess 20 so that after possible adjustment of the hinge arm in the third axis in space, i.e. after displacement of the bearing element 3 relative to the intermediate carrier 4 in the direction indicated by the arrow A, the screw 13 can be tightened. Since the width of the extension 5 in the direction of the double-ended arrow B is slightly greater than the corresponding width of the recess 10, the extension 5 is wedged tightly in the recess 10 by this tightening of the screw 13, so that after the tightening of the screw 13 a dependable anchoring between the intermediate carrier 2 and the bearing element 3 is assured.

The intermediate carrier 2 as well as the bearing element are made, for instance, of plastic. However, it is also possible merely to make the intermediate carrier 2 of plastic and to use metal for the bearing element 3.

Furthermore, instead of the leaf spring 33 there can also be used a spring of different design, made of metal or an elastic material.

What is claimed is:

1. A cabinet hinge base plate permitting adjustable attachment of a hinge arm to a cabinet component, said plate consisting of (a) an intermediate carrier having upper and lower faces, parallel end faces and parallel side faces, said upper face having defined thereon intermediate to said end faces a guide extension, said guide extension having an upper surface disposed across the width of said carrier and parallel to said upper face and two guide surfaces disposed across the width of the carrier and transverse to said guide extension upper face and said upper surface of said intermediate carrier, (b) means operable to fix said intermediate carrier to said cabinet component, (c) a bearing element having a recess defined in its lower surface, said recess being operable to receive said intermediate carrier and having a width greater than the width of said carrier, said bearing element having a pair of bearing surfaces defined within said recess and complementing said guide surfaces so as to permit positioning of said bearing element relative to said intermediate carrier along a first spacial axis parallel to the width of said intermediate carrier, said bearing element further having a pair of longitudinal legs defined on either side of said recess so as to straddle said intermediate carrier, said legs being of such length as to extend to the lower face of said carrier when said carrier is received in said recess, (d) means operable to fix said bearing element to said intermediate carrier after positioning along said first axis, and (e) means operable to position said hinge arm along a second spacial axis parallel to the length of said intermediate carrier and to fix said hinge arm to said bearing element after said positioning.

2. A plate according to claim 1 wherein said recess has bearing surfaces complementing both said guide surfaces and said upper surface of said guide extension.

3. A plate according to claim 1 wherein at least one of said intermediate carrier and said bearing element is plastic.

4. A plate according to claim 1 wherein at least one of said intermediate carrier and said bearing element is metal.

5. A plate according to claim 1 wherein at least one of said guide surfaces slopes from said upper surface of said guide extension to said upper face of said intermediate carrier towards the more proximate end face of said carrier.

6. A plate according to claim 5 wherein said guide extension is trapezoidally in longitudinal cross section.

7. A plate according to claim 1 wherein said means for fixing said bearing element to said intermediate carrier includes a slot in said bearing element, a threaded borehole in said intermediate carrier and a threaded member passing through said slot and engaging said borehole.

8. A plate according to claim 7 wherein said borehole is disposed through the upper surface of said guide extension.

* * * * *